United States Patent [19]

Sato et al.

[11] Patent Number: 4,967,584

[45] Date of Patent: Nov. 6, 1990

[54] METHOD OF MAKING A FORGING IN CLOSED-DIES

[75] Inventors: Masataka Sato, Tokyo; Tomoyoshi Sato, Fujisawa, both of Japan

[73] Assignee: Nissan Motor Co., Ltd., Yokohama, Japan

[21] Appl. No.: 311,258

[22] Filed: Feb. 16, 1989

[30] Foreign Application Priority Data

Feb. 19, 1988 [JP] Japan ..... 63-35322
Feb. 19, 1988 [JP] Japan ..... 63-35323

[51] Int. Cl.[5] ..... B21D 22/00; B21D 53/88; B21K 1/74

[52] U.S. Cl. ..... 72/356; 72/352; 72/358; 72/359; 72/377

[58] Field of Search ..... 72/354, 356, 358, 359, 72/353, 360, 352, 357, 377

[56] References Cited

U.S. PATENT DOCUMENTS 1,952,491 3/1934 Bush et al. ..... 72/356
3,889,512 6/1975 Delio ..... 72/356
4,287,747 9/1981 Koshimuru et al. ..... 72/358
4,342,213 8/1982 Koshimuru et al. ..... 72/356

FOREIGN PATENT DOCUMENTS 92245 7/1980 Japan ..... 72/356
30252 2/1986 Japan ..... 72/356
77143 4/1987 Japan ..... 72/359
156043 7/1987 Japan ..... 72/356
804468 11/1958 United Kingdom ..... 72/356

*Primary Examiner*—Robert L. Spruill
*Attorney, Agent, or Firm*—Pennie & Edmonds

[57] ABSTRACT

A closed-die forging having an annular flat surface portion and a corner portion at an outer periphery of the annular flat surface portion is made by a method consisting of a rough forging process and a finish forging process. In the rough forging process, a rough forged product is shaped so as to have an annular flat surface portion smaller in outer diameter than the first mentioned annular flat surface portion and a conical surface portion at an outer periphery of the second mentioned annular flat surface portion. The conical surface portion is so shaped as to extend increasingly outwards as it extend in the same direction of movement of a punch of a rough forging die for performing a forming operation. In the finish forging process, the conical surface portion is pushed by a punch of a finish forging die in the same direction as the rough forging product is pushed by the first mentioned punch in the rough forging process and thereby formed together with the second mentioned annular flat surface into the first mentioned annular flat surface portion perpendicular to the direction of movement of the second mentioned punch.

6 Claims, 10 Drawing Sheets

METHOD OF MAKING A FORGING IN CLOSED-DIES

BACKGROUND OF THE INVENTION

1. Field of the Invention

The present invention relates to a method of making a closed-die forging, particularly of the kind having a flat surface larger than a corresponding flat surface of a blank.

2. Description of the Prior Art

An example of a closed-die forging of the above described kind is shown in FIG. 4. The forging is a constituent part 1 of a knuckle joint for an automotive steering system and in the form of having a spindle 2 and a main body 3 supporting the spindle 2. The main body 3 has an annular flat surface 3*a* around the spindle 2 and a corner portion 3*b* at the outer periphery of the flat surface 3*a*. Such a knuckle joint constituent part 1 is usually produced by a forging process that causes an excess metal or a parting-line flash around a forging. That is, in the forging process, a hot blank is forged in a die in such a way that an excess metal or flash is formed around the main body 3, the arms 4–6, boss 7, etc. in order to assure good die filling. The flash is removed by trimming.

The large flash that is removed by trimming reduces a yield rate of material (i.e., a percentage of forging to blank by weight) to 60% or so. To solve this problem, it is considered to make the knuckle joint constituent part 1 by a closed-die forging process for thereby increasing the yield rate up to 100%.

In the closed-die forging process, such a forging die shown in FIG. 10 is used. The forging die consists of a die 8, an outer punch 9 to be matched with the die 8 and an inner punch 10 slidably installed in the outer punch 9. With the die 8 and the outer punch 9 being held closed, a hot blank 11 heated up to 1250° C. is pushed up by the inner punch 10 with a pressure of 80 $Kg/mm^2$ and thereby formed into the knuckle joint constituent part 1.

In the above described closed-die forging process, the blank 11 of a diameter smaller than the outer diameter of the flat surface 3*a* of the knuckle joint constituent part 1 is used in order that the blank 11 is deformed so as to efficiently fill a cavity of the inner punch 10 for forming the spindle 2. Further, in order to prevent defects in the forged product due to buckling of the blank 11, it is necessary that the diameter of the inner punch 10 is smaller than the outer diameter of the flat surface 3*a* and a little larger than the diameter of the blank 11.

However, the material flow of the blank 11 in the closed-die forging process is restricted considerably as compared with the forging process that causes the flash around the forged product. Due to this, the workpiece is formed with a corner portion 11*a* at a certain stage before completion of the forging process, i.e., when the inner punch 10 is still moving toward its upper most position as shown in FIG. 11A. As the inner punch 10 further moves toward the upper most position where the blank is completely forged, the corner portion 11*a* is bent inwards of the workpiece, which can cause a flaw or flaws 12 in the flat surface 3*a* of the main body 3 of the knuckle joint constituent part 1 as shown in FIG. 11B.

SUMMARY OF THE INVENTION

In accordance with the present invention, there is provided an improved method of making a closed-die forging having a flat surface.

The method comprises a rough forging process for pushing a blank by a punch and thereby forming the blank into a rough forged product having a conical surface which is so shaped as to extend increasingly outwards as it extends in the same direction of movement of the punch for performing a forming operation and a finish forging process for pushing the conical surface by a punch in the same direction as the rough forged product is pushed by the first mentioned punch in the rough forging process and thereby forming the conical surface into the flat surface.

The method is effective for solving the above noted problem inherent in the prior art closed-die forging.

It is accordingly an object of the present invention to provide a novel method of making a closed-die forging which can increase the yield rate of material up to 100%.

It is another object of the present invention to provide a novel method of the above described character which can assuredly prevent formation of defects as flaws and wrinkles in the closed-die forging.

DESCRIPTION OF THE PREFERRED EMBODIMENTS

Figure 1A:
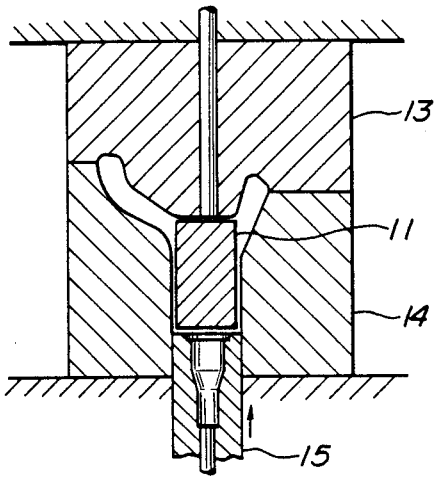
FIG. 1A is a fragmentary sectional view of a die for use in a preforming or rough forging process of a method of making a closed-die forging according to an embodiment of the present invention.
Figure 1B:
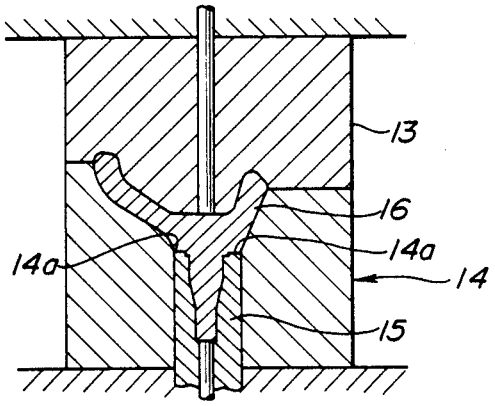
FIG. 1B is a view similar to FIG. 1A but showing the rough forging process in a different state.
Figure 4:
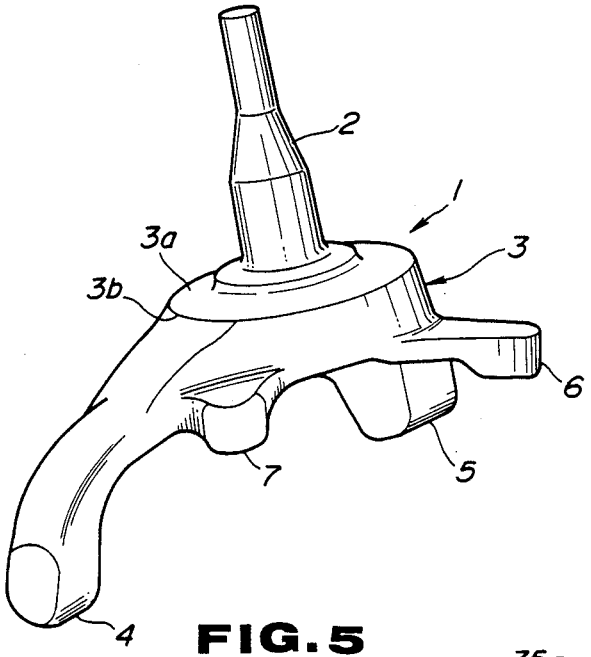
FIG. 4 is a perspective view of a knuckle joint constituent part which is an example of a product made by the method according to the above described embodiment of this invention.

Referring first to FIGS. 1A–1B to 4, a method of making a closed-die forging according to an embodiment of this invention is applied by way of example to production of a constituent part 1 of a knuckle joint for an automotive steering system shown in FIG. 4.

Figure 2:
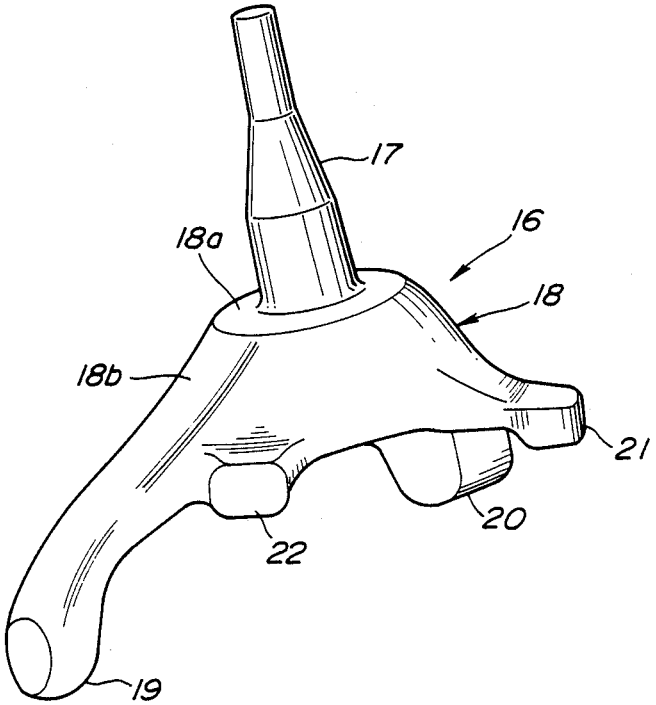
FIG. 2 is a perspective view of a product made by the above described rough forging process.
Figure 10:
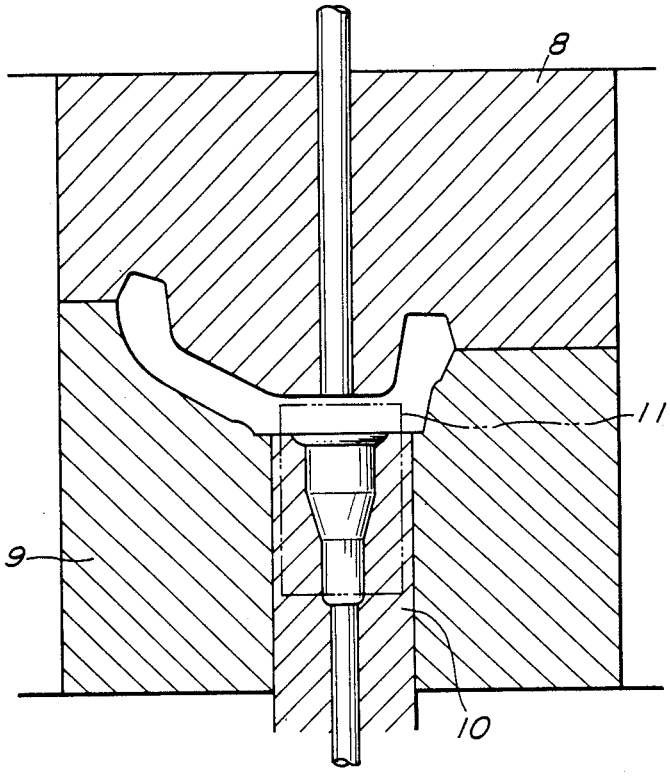
FIG. 10 (PRIOR ART)
FIGS. 10 and 11A–11B are views showing a prior art forging process.
Figure 11A:
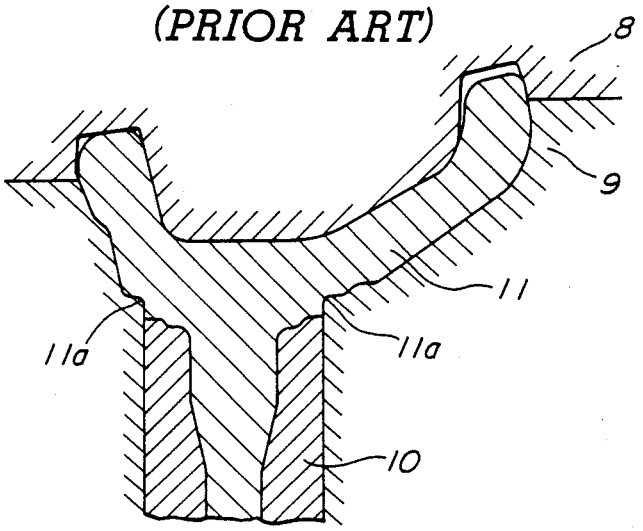
FIG. 11A (PRIOR ART)
Figure 11B:
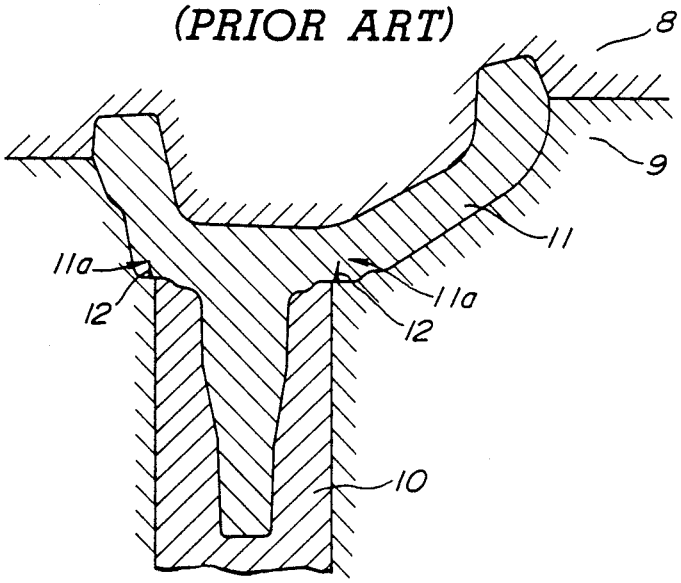
FIG. 11B (PRIOR ART)

The method of this invention comprises a preforging or rough forging process and a finish forging process. In the rough forging process, a rough forging die shown in FIGS. 1A and 1B is used. The rough forging die includes a die 13, an outer punch 14 to be matched with the die 13 and having a central opening and an inner punch 15 slidably installed in the central opening of the outer punch 14 and extending therethrough. The die 13 and the outer punch 14 are matched so as to define part of a cavity for forming a predetermined preforged or rough forged product 16 shown in an enlarged scale in FIG. 2. The remaining part of the cavity is formed in the inner punch 15. The diameter of the inner punch 15 is a little larger than that of a blank for the knuckle joint constituent part 1, similarly to the inner punch 10 of the prior art forging die of FIG. 10.

In the rough forging process, a hot billet or blank 11 is placed on the inner punch 15 as shown in FIG. 1A. With the die 13 and the outer punch 14 being held closed, the inner punch 15 is pushed upwards and moved into its upper most position as shown in FIG. 1B, whereby to form the blank 11 into the rough forged product 16.

The rough forged product 16 has a spindle preforming portion 17 to be formed into a spindle 2, a main body preforming portion 18 to be formed into a main body 3, a plurality of projections 19–22 to be formed into a plurality of arms 4–6 and a boss 7. Further, the main body preforming portion 18 has an annular flat surface 18*a* of an outer diameter equal to the diameter of the inner punch 15 and a conical surface 18*b* extending outwardly from the outer periphery of the flat surface 18*a*. The conical surface 18*b* is so shaped as to extend increasingly outwards as it extends in the same direction of movement of the inner punch 15 for performing a preforging operation.

Figure 3A:
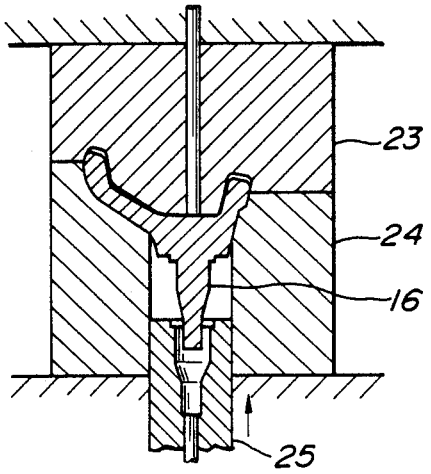
FIG. 3A is a fragmentary sectional view of a die for use in a finish forging process of the method according to the above described embodiment of the present invention.
Figure 3B:
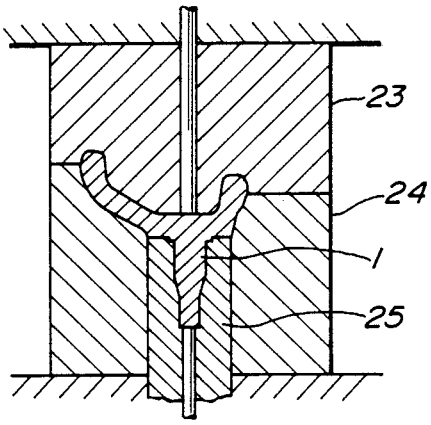
FIG. 3B is a view similar to FIG. 3A but showing the above described finish forging process in a different state.

In the finish forging process, a finish forging die shown in FIGS. 3A and 3B is used. The finish forging die includes a die 23, an outer punch 24 to be matched with the die 23 and having a central opening and an inner punch 25 slidably installed in the outer punch 24 and extending therethrough. The die 23 and the outer punch 24 are matched so as to define part of a cavity for forming the knuckle joint constituent part 1. The remaining part of the cavity is formed in the inner punch 25. The inner punch 25 has a top face corresponding in shape and size to the flat surface 3*a* of the knuckle joint constituent part 1.

In the finish forging process, the hot rough forged product 16 is placed on the outer punch 24 and then received in the cavity defined by the die 23 and the outer punch 24 as shown in FIG. 3A. The inner punch 25 is then pushed upwards and moved into its upper most position as shown in FIG. 3B, whereby to press the rough forged product 16, particularly the main body preforming portion 18*a* against the die 23 and thereby form the same into the knuckle joint constituent part 1 shown in FIG. 4.

In this instance, the conical surface 18*b* of the main body preforming portion 18 of the rough forged product 16 is pushed by the top face of the inner punch 25 in the same direction as the rough forged product 16 is pushed by the inner punch 15 in the rough forging process, together with the flat surface 18*a*, thus being formed into the flat surface 3*a* of the knuckle joint constituent part 1 without causing the surface material to be bent inwards of the product.

In the foregoing, it is to be noted that the rough forged product 16 has the conical outer surface portion 18*b* at the outer periphery of the annular flat surface portion 18*a* shaped after the top face of the inner punch 15. This is effective for attaining good material flow of the blank 11 since the direction of the material flow becomes nearer the direction of movement of the inner punch 15 than that in the case where the above described conical outer surface is otherwise formed into a flat shape perpendicular to the direction of movement of the inner punch 15.

It is further to be noted that since the edge 14*a* of the outer punch 14 around the inner punch 15 is shaped so as to form an obtuse angle, the material can flow over the edge 14*a* easily and smoothly in response to upward movement of the inner punch 15, whereby to make it possible to prevent formation of such a flaw or flaws that are caused by the surface material being bent inwards of the forged product. In the finish forging process, there does not occur such material flow that causes the surface material to be bent inwards of the product. Therefore, no flaw is caused in the flat surface 3*a* in the knuckle joint constituent part 1.

From the foregoing, it will be understood that the method of this invention is particularly useful for making a closed-die forging in the form of having an annular surface portion perpendicular to the direction of movement of a punch of a forging die for performing a forming operation and a corner portion around the annular surface portion.

Figure 6A:
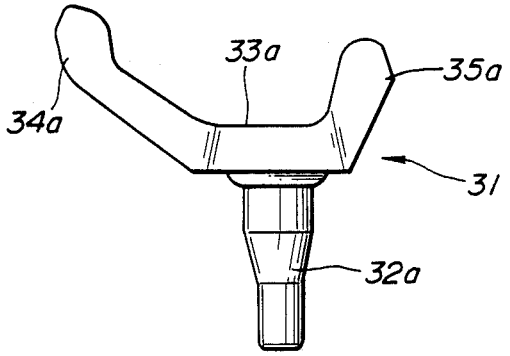
FIG. 6A is a foreshortened side elevational view of the rough forged product of FIG. 5.
Figure 6B:
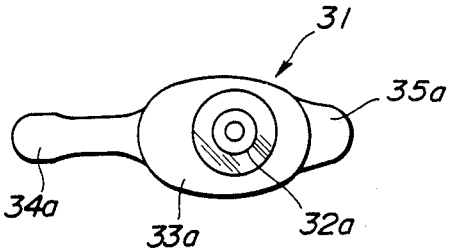
FIG. 6B is a bottom plan view of the rough forged product of FIG. 6A.
Figure 7:
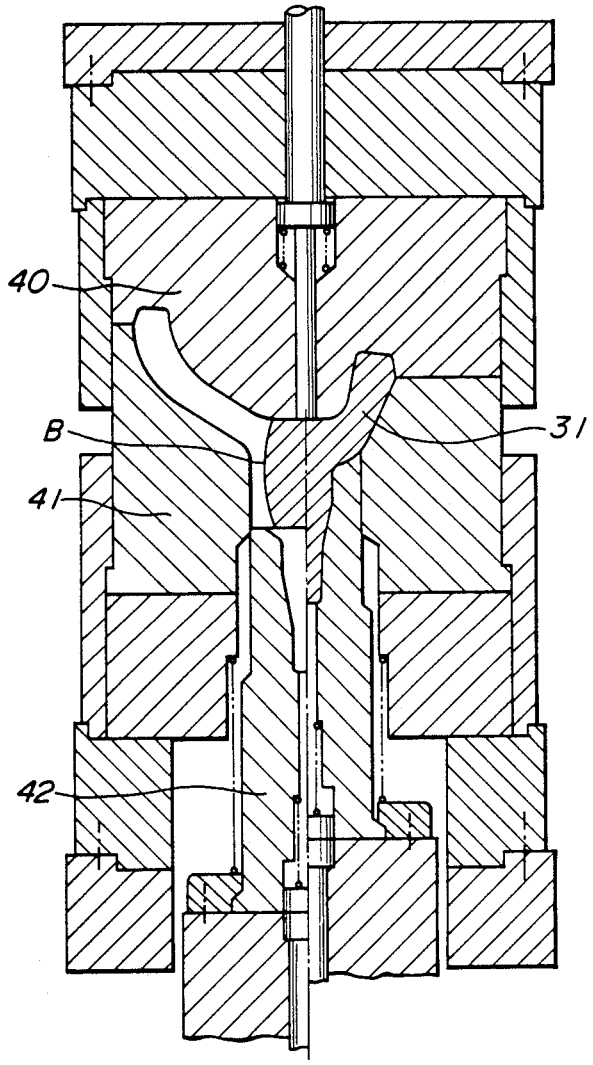
FIG. 7 is a sectional view of a die for use in a preforging or rough forging process of the method according to the above described other embodiment of the present invention.
Figure 8A:
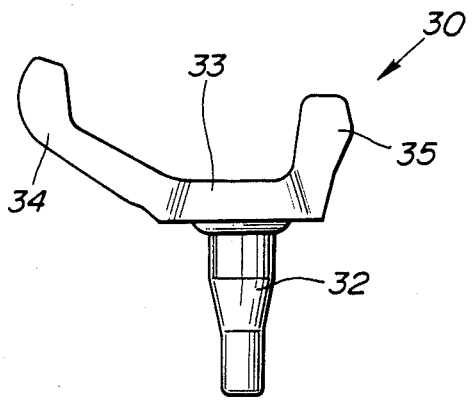
FIG. 8A is a side elevational view of a finished forging or finish forged product made by the method according to the above described other embodiment of the present invention.
Figure 8B:
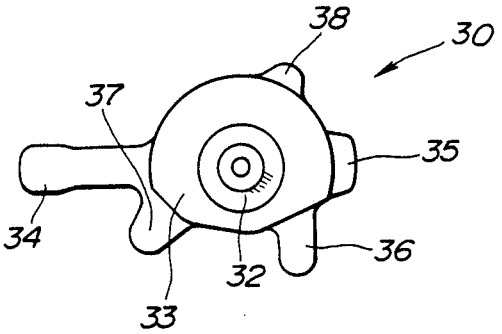
FIG. 8B is a bottom plan view of the finish forged product of FIG. 8A.

Referring to FIGS. 5 to 9, a method of making a closed-die forging according to another embodiment of the present invention is applied to production of a knuckle joint constituent part 30 shown in FIGS. 8A and 8B.

The knuckle joint constituent part 30 has a spindle 32 and a main body 33 from which the spindle 32 projects. The knuckle joint constituent part 30 further has an upper arm 34, a lower arm 35, a lower caliper boss 36, an upper caliper boss 37 and a caliper arm 38 which project from the main body 33 in the various directions. The upper and lower arms 34 and 35 differ in length considerably from the caliper bosses 36 and 37 and the caliper arm 38. That is, the upper and lower arms 34 and 35 are relatively long whereas the caliper bosses 36 and 37 and the caliper arm 38 are relatively short.

Figure 5:
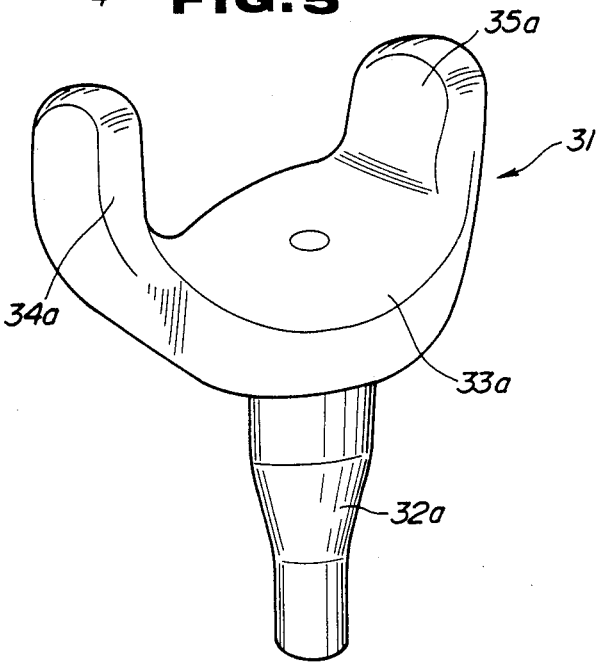
FIG. 5 is a perspective view of a preforged or rough forged product made by the method according to another embodiment of the present invention.

In the rough forging process, a hot descaled billet or blank "B" in the form of a barrel is formed into a preforged or rough forged product 31 shown in FIGS. 5 and 6A–6B. The rough forged product 31 has a spindle preforming portion 32*a*, a main body preforming portion 33*a*, an upper arm preforming portion 34*a* and a lower arm preforming portion 35*a*. The lengths, widths and thicknesses of the preforming portions 34*a* and 35*a* are suitably determined so that the formings of the preforming portions 34*a* and 35*a* are completed substantially at the same time as the formings of the remaining portions of the rough forged product 30 are completed, i.e., the substantial material flow or deformation at various portions of the rough forged product 30 is completed at substantially the same time.

The rough forging process is performed by using a die shown in FIG. 7 similarly to the previous embodiment of FIGS. 1A–1B to 4. The die includes a die 40, an outer punch 41 and an inner punch 42.

In the finish forging process, the spindle preforming portion 32*a* and the main body preforming portion 33*a* are formed into the spindle 32 and the main body 33 of the predetermined shapes and sizes whilst at the same time the upper and lower arm preforming portions 34*a* and 35*a* are formed into the upper and lower arms 34 and 35 projecting from the main body 33 in the predetermined manners. Further, at the same time with the above, the caliper arm 38, upper caliper boss 37 and lower caliper boss 36 which are of relatively small extension from the main body 33 are formed, whereby to form the rough forged product 31 into the knuckle joint constituent part 30.

In the finish forging process, the time necessary for forming the arms 34 and 35 can be reduced considerably by the provision of the arm preforming portions 34*a* and 35*a* of the rough forged product 31. Accordingly, the formings of the arms 34 and 35 can be completed at substantially the same time as the formings of the caliper arm 38 and the caliper bosses 36 and 37 are completed.

Figure 9:
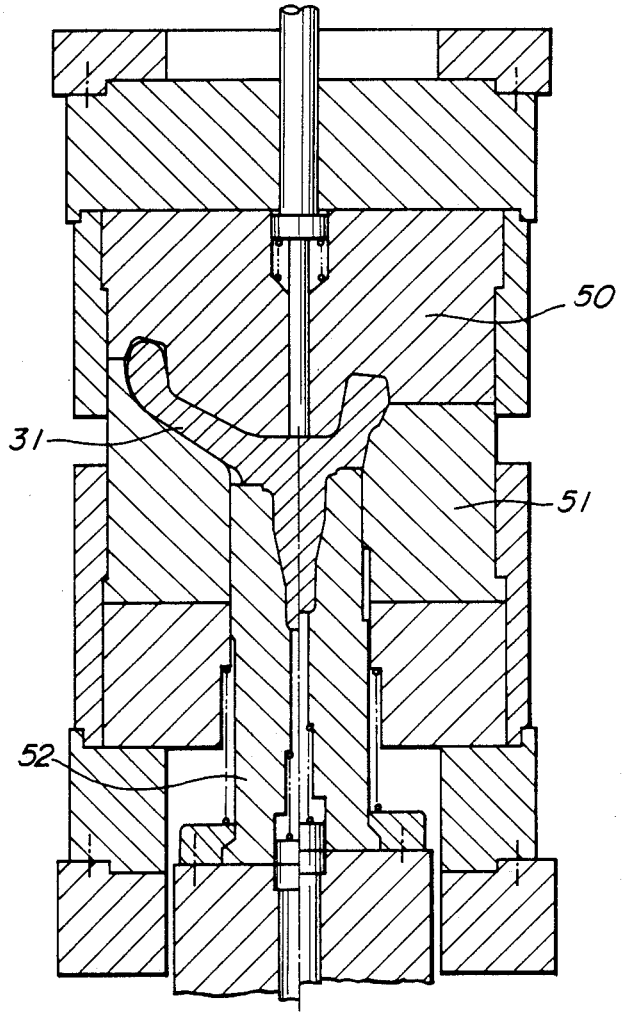
FIG. 9 is a sectional view of a die for use in a finish forging process of the method according to the above described other embodiment of the present invention.

The finish forging process is performed by using a die shown in FIG. 9 similarly to the previous embodiment of FIGS. 1A–1B to 4. The die includes a die 50, an outer punch 51 and an inner punch 52. In FIG. 9, the die is shown in the left hand half in the state prior to begining of the finish forging operation and in the right hand half in the state when the finish forging operation is completed.

Except for the above, this embodiment is substantially similar to the previous embodiment of FIGS. 1A–1B and 4.

With the above described method according to another embodiment of this invention, the material flows for forming the arms and bosses of the considerably different lengths and sizes are completed at substantially the same time. When the knuckle joint constituent part 30 is produced by the prior art closed-die forging process, i.e., made by a single forging process, flaws and wrinkles are created in the product by the cause of the difference in the times at which the formings of the various portions of the knuckle joint constituent part 30 are completed. The above describe other embodiment of this invention is effective for preventing formation of such flaws and wrinkles in the closed-die forging.

What is claimed is:

1. A method of making a forging in closed dies, the forging having an annular flat surface portion and a corner portion at an outer periphery of the annular flat surface portion, the method comprising:

rough forging a blank in a first closed die by pushing said blank into a die cavity for producing by a first punch a rough forged product having an annular flat surface portion of a lesser outer diameter than said first mentioned annular flat surface portion and a conical surface portion at an outer periphery of said second mentioned annular flat surface portion, said conical surface portion being so shaped as to extend increasingly outwards as it extends in the direction of being pushed by said punch; and finish forging said rough forged product in a second closed die by pushing said conical surface portion and said second mentioned annular flat surface portion into a cavity of the second closed die by a punch having a greater lateral dimension than said first mentioned punch in the same direction as said rough forged product is pushed by said first mentioned punch and thereby finish forging said conical surface portion and said second mentioned annular flat surface portion into said corner portion and into said first mentioned annular flat surface portion perpendicular to the direction of movement of said second mentioned punch.

2. The method according to claim 1 wherein said forging further has a main body and a plurality of projections of different lengths which are formed by said rough forging process in such a manner that forming of said longer projection and said main body are completed substantially at the same time, said main body, said longer projection and the remaining of said projections being finish forged in such a way that forming of said main body and said projections are completed substantially at the same time.

3. A method of making a forging in closed-dies, said forging having a main body, a spindle projecting from said main body and a plurality of projections projecting from said main body, said main body having an annular flat surface portion around said spindle and a corner portion at an outer periphery of said annular flat surface portion, said method comprising:

providing a rough forging closed-die unit for producing a rough forged product having a main body preforming portion and a spindle preforming portion, said main body preforming portion having an annular flat surface portion around said spindle preforming portion and a conical surface portion at an outer periphery of said second mentioned annular flat surface portion, said second mentioned annular flat surface portion having an outer diameter smaller than that of said first mentioned annular flat surface portion, said rough forging closed-die unit having a die, an outer punch to be matched with said die to define part of a cavity for forming said rough forged product and an inner punch slidably installed in said outer punch having a remaining part of said cavity, said inner punch having a diameter smaller than the outer diameter of said first mentioned annular flat surface portion;

providing a cylindrical blank of a diameter of little smaller than the diameter of said inner punch;

forming said blank into said rough forged product by pushing said blank into said cavities of said rough forging closed-die unit by said inner punch;

providing a finish forging closed-die unit for producing said forging, said finish forging die unit having a die, an outer punch to be matched with said die of said finish forging die unit for defining a part of a cavity for forming said forging and an inner punch slidably installed in said outer punch of said finish forging closed-die unit and having the remaining part of said cavity for forming said forging, said inner punch of said finish forging closed-die unit having a diameter equal to the outer diameter of said first mentioned annular flat surface portion of said forging; and forming said rough forged product into said forging by pushing said rough forged product into said cavities of said finish forging closed-die unit by said inner punch;

said forming of said rough forged product in said finish forging closed-die unit including forming said first mentioned flat surface portion and said corner portion from said conical surface portion and said second mentioned annular flat surface portion.

4. A method of making a forging in closed-die, the forging having a main body and a plurality of projections of different lengths, the method comprising:

preforming said main body and longer one of said projections by a rough forging process in a first closed-die; and finish forming said main body, said longer projection and a remainder of said projections by a finish forging process in a second closed-die.

5. A method of making a forging in closed-dies, the forging having a main body and a plurality of projections of different lengths, the method comprising:

rough forging said main body and longer one of said projections in a first closed-die in such a manner that formings of said longer projection and said main body are completed substantially at the same time; and finish forging said main body, said longer projection and a remainder of said projections in a second closed-die in such a manner that formings of said main body and said projections are completed substantially at the same time.

6. A method of closed-die forging a knuckle joint constituent part in the form of having a main body, a spindle, an upper arm, a lower arm, a caliper arm, an upper caliper boss and a lower caliper boss, in which said spindle and said upper and lower arms are considerably longer than said caliper arm and said upper and lower caliper bosses, said method comprising:

providing a rough forging closed-die unit for producing a rough forged product having a main body preforming portion, a spindle preforming portion, an upper arm preforming portion and a lower arm preforming portion, said rough forging closed-die unit having a die, an outer punch to be matched with said die for defining part of a cavity for forming said rough forged product and an inner punch slidably installed in said auto punch and defining a remaining part of said cavity, said rough forged product being shaped and sized so that forming of said main body preforming portion and said lower arm preforming portion are completed substantially at the same time;

preparing a blank in the form of a barrel;

forming said blank into said rough forged product by pushing said blank into said cavities of said rough forging closed-die unit by said inner punch;

providing a finish forging closed-die unit for producing said knuckle joint constituent part, said finish forging closed-die unit having a die, an outer punch to be matched with said die for defining part of a cavity for forming said knuckle joint constituent part and an inner punch slidably installed in said outer punch and defining a remaining part of said second mentioned cavity, said rough forged product being shaped and sized so that finish formings of said main body, and spindle, said upper arm, said lower arm, said caliper arm, said upper caliper boss and said lower caliper boss are completed substantially at the same time; and forming said rough forged product into said knuckle joint constituent part by pushing said rough forged product into said cavities of said finish forging closed-die unit by said inner punch.

* * * * *